United States Patent [19]

Bechtiger

[11] 4,224,814

[45] Sep. 30, 1980

[54] TIME LOCK HAVING RELEASABLE CARRIER LATCHING DEADBOLT

[75] Inventor: Charles G. Bechtiger, La Chaux-de-Fonds, Switzerland

[73] Assignee: Sargent & Greenleaf, Inc., Nicholasville, Ky.

[21] Appl. No.: 8,850

[22] Filed: Feb. 2, 1979

[51] Int. Cl.[3] ..... E05B 43/00

[52] U.S. Cl. ..... 70/272; 70/267; 70/416

[58] Field of Search ..... 70/272–274, 70/267–271, 416, 418

[56] References Cited

U.S. PATENT DOCUMENTS

| | | | |
|---|---|---|---|
| 293,815 | 2/1884 | Stockwell et al. | 70/416 X |
| 976,028 | 11/1910 | Benham | 70/273 |
| 4,062,210 | 12/1977 | Uyeda | 70/272 X |

*Primary Examiner*—William E. Lyddane

*Attorney, Agent, or Firm*—Mason, Fenwick & Lawrence

[57] ABSTRACT

A time lock for bank vault doors and the like having timer units of the settable dial type, a carrier assembly transversely movable in the housing between a locking position and a release position for locking and releasing a snubber bar blocking mechanism, the timer units having an actuator for engaging and moving the carrier assembly from said locking position to said release position when the dial reaches zero time position. The carrier assembly includes two relatively movable plates having abutment formations to be engaged by each actuator, the abutment formations of one plate extending a short distance ahead of the abutment formations of the other to be first engaged by the actuator and first move the one plate, and a pivoted deadbolt latch lever resiliently biased against a stationary stop for holding the carrier assembly against movement from said locking position and movable out of engagement with said stop upon movement of the one plate by the actuator.

16 Claims, 7 Drawing Figures

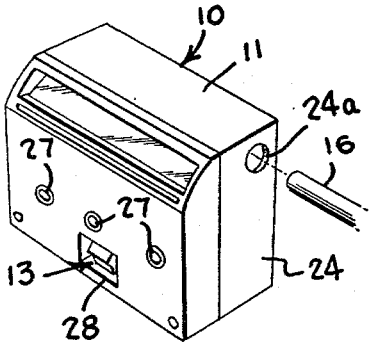
FIG-1
FIG-3
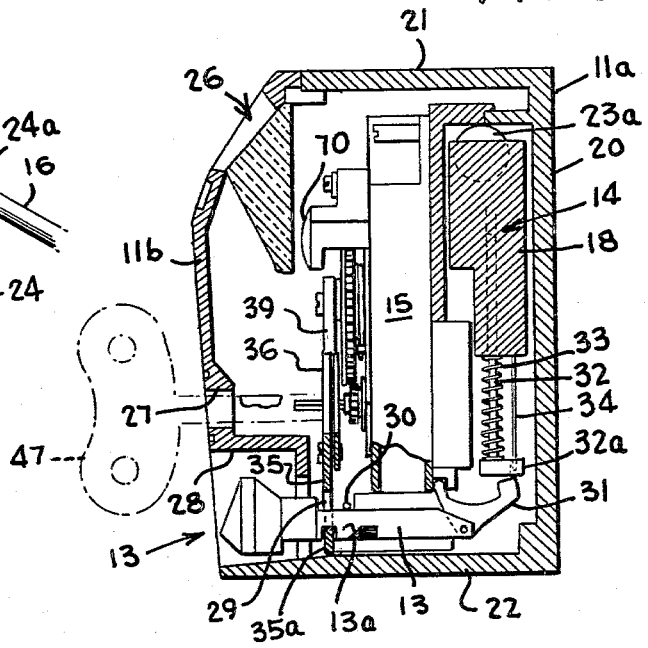
FIG-2
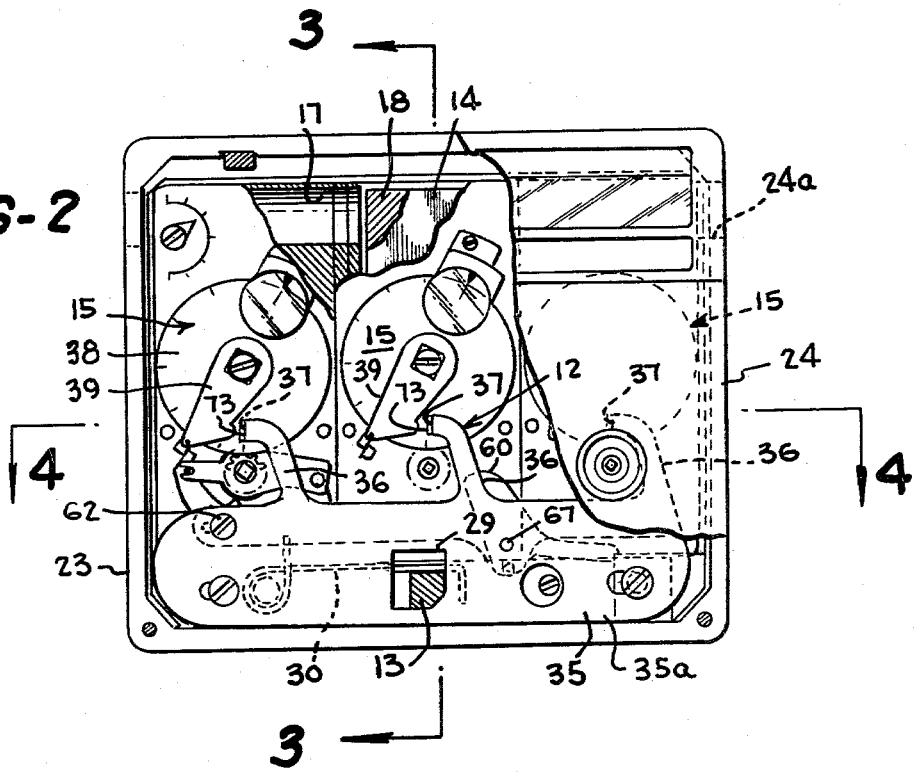

FIG-7
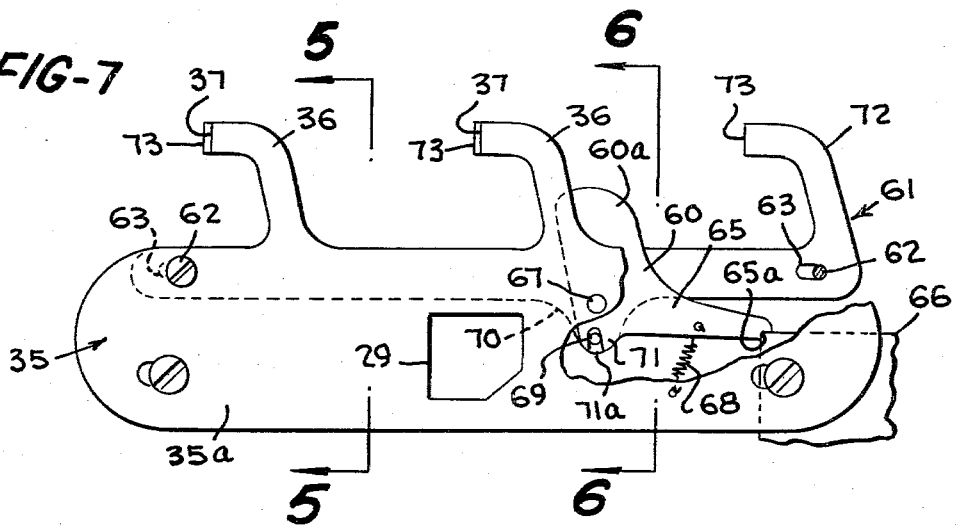
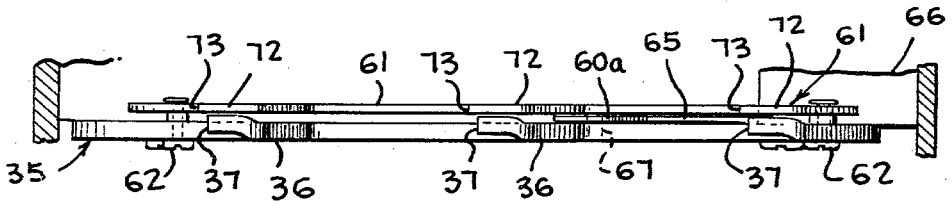
FIG-4
FIG-5
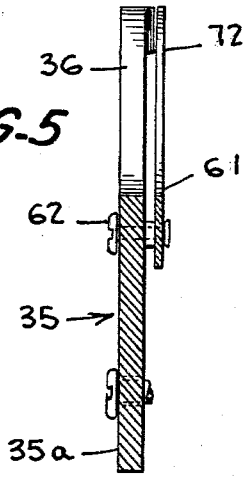
FIG-6
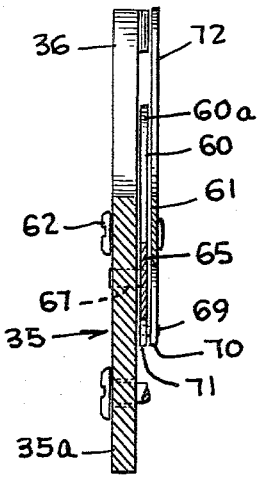

TIME LOCK HAVING RELEASABLE CARRIER LATCHING DEADBOLT

BACKGROUND AND OBJECTS OF THE INVENTION

The present invention relates in general to time locks for bank vaults and safes and similar timed high security devices for security receptacles, and more particularly to the carrier structure of manually settable time locks providing means for releasibly holding the carrier against accidental or vibrational lateral movement toward its unlocking position releasing a lever or similar actuator to unlock the time lock and which releases the carrier to undergo unlocking movement when the timing mechanism times down to zero.

Heretofore, time locks have been in common, widespread use to place bank vaults and similar safes, security spaces, and the like in a lock-out condition rendering them disabled from being opened in the normal way by bank personnel, as by proper dialing of a combination lock, during certain chosen times, such as between the bank closing time one day and its opening time the next banking day. In recent years, these time locks have customarily involved a box or case having two or three timer units or clockwork movements, to provide backup redundancy in case one or two of the timer units fail, each of which has a settable dial graduated in hours and set from a key insertable into openings in the time lock case to indicate the desired locking hours or time lapse between setting of the timer and the time of opening of the vault the next working day. Each timer unit or movement customarily has a main spring and gear system to concurrently wind the main drive spring for the clockwork mechanism and drive the dial in a wind-up or increasing time lapse direction relative to a stationary pointer or index mark, and the dial usually has a trip pin or stub fixed on the dial face to engage an abutment surface on the end of one of a plurality of rigid arms extending from a transversely movable carrier when the associated timer unit dial times out to zero time and move the carrier to a release position allowing a snubber bar connected in the usual manner to the bolts for the vault door, as by connection to a common control bar for the bolts to retract to unlocking position. Alternatively, a snap action trip arm mechanism may be provided with each timer unit to abruptly kick the carrier toward release position at zero time, as disclosed in U.S. patent application Ser. No. 940,834 filed Sept. 7, 1978 by Charles G. Bechtiger et al, owned by the assignee of the present application. The carrier typically has three of such rigid arms extending to abutment ends located at the zero time positions for the trip pins of each of the three dials of the three timer units, so that any one of the three trip pins when it engages the abutment end surface of the associated extension arm of the carrier will push the carrier toward its release position by the force of the stored energy in the associated main drive spring to unlock the time lock.

The carrier is usually only spring biased to locking position and typically moves only a short distance transversely of the time lock to effect release of the time lock, usually by withdrawing a small abutment surface bounding a slot from holding position relative to a notch or shoulder of a push lever or actuator accessible from the front of the time lock case and allowing a blocking member to drop from blocking relation to a snubber bar connected to the vault door bolts. It is possible that vibration of the time lock mechanism from various sources could cause sufficient movement of the carrier toward release position against the spring bias of the usual carrier retaining spring to effect accidental or surreptitious release of the time lock. Sidewise accelerations issuing for instance from external shocks can exert a force onto the carrier plate in the direction of making it open the lock. A force acting in a direction toward the release position of the carrier, or to the right as viewed in FIGS. 2 and 7 of this application may overcome the retaining action of the carrier retaining spring. The main carrier plate must be strong and therefore massive because of functional requirements. The retaining spring cannot be made very strong in order not to overload the timing mechanisms when releasing. The ratio of carrier mass to retaining spring force is therefore high and cannot be reduced below a limit given by considerations of design and proper functioning. Therefore, there exists always a force of relatively small value sufficient to shift the carrier plate in the opening direction.

An object of the present invention is the provision of a novel carrier mechanism for time locks designed to overcome the above-described problem, wherein a deadbolt latch lever is provided on the carrier which is latched against a stop shoulder when the timer mechanisms are above zero time condition and is released to allow the carrier of the time lock to shift to release position when the dial times down to zero time.

Another object of the present invention is the provision of a novel carrier mechanism for time locks as described in the immediately preceding paragraph, wherein a slide plate parallels and is slidable relative to the carrier and includes means for swinging the latch lever between carrier latching position and carrier release position when the slide plate is moved between a normal and a displaced position, and the slide plate includes abutments to be engaged by the trip mechanism of the timer units immediately prior to engagement of the carrier to move the latch lever to release position.

Other objects, advantages and capabilities of the present invention will become apparent from the following detailed description, taken in conjunction with the accompanying drawings showing a preferred embodiment of the invention.

BRIEF DESCRIPTION OF THE FIGURES

FIG. 1 is a front perspective view of a time lock for safes, vaults and similar enclosures embodying the present invention;

FIG. 2 is a front elevation view thereof with parts of the front cover and of the carrier member broken away;

FIG. 3 is a vertical transverse section view thereof taken along the line 3—3 of FIG. 2;

FIG. 4 is a fragmentary horizontal section view taken along the line 4—4 of FIG. 2, showing the novel carrier and deadbolt latch lever mechanism of the present invention in top plan;

FIG. 5 is a vertical section view taken along the line 5—5 of FIG. 7;

FIG. 6 is a vertical section view taken along the line 6—6 of FIG. 7; and

FIG. 7 is a fragmentary front elevation view of the carrier assembly with the deadbolt latch lever and release actuator therefor, viewed from a section plane immediately forwardly of the carrier, with parts broken away.

DETAILED DESCRIPTION OF A PREFERRED EMBODIMENT

Referring to the drawings, wherein like reference characters designate corresponding parts throughout the several figures, there is shown a typical time lock, generally indicated by the reference character 10, having a case or housing 11 of generally rectangular box-like form for housing the components of the time lock including the usual carrier assembly 12 for normally latching a push lever 13 in a locking position holding a snubber bar blocking mechanism 14 in a blocking position, the carrier assembly being movable by a clockwork mechanism actuator. In the preferred embodiment, three such clockwork mechanisms, movements or timer units, indicated generally by the reference character 15, are provided, each having an actuator for engaging an abutment surface of the carrier assembly 12 as later described. While it will be appreciated that only one of such clockwork mechanisms or timer units 15 is required, it is customary to provide more than one unit, usually two or three such units, to provide appropriate backup or redundancy in the event one of the timer units fails. When the actuator of one or more of the timer units 15 times down to zero time, it engages the carrier assembly and moves it to a release position causing the push lever 13 and blocking mechanism 14 to free a snubber bar 16 to retract to unlocking position. The snubber bar 16 is usually installed on the door or wall of a safe or vault and is connected to the customary control bar coordinating locking and unlocking movement of the door bolts into and withdrawal from sockets in the companion wall or door jamb portion. The snubber bar 16 includes an inner end portion which extends into a transverse horizontal cylindrical bore 17 in the time lock causing 11. In the locked position of the time lock, a blocking member 18 occupies the position shown in FIGS. 2 and 3 blocking the midportion of the cylindrical bore 17 so that the snubber bar 16 is blocked in its outwardly projecting or locking position. When the blocking member 18 is retracted downwardly, or moved downwardly under force of gravity, upon movement of the push lever 13 to the release or outward position, either manually, as for emergency release, or mechanically by transverse movement of the carrier when one of the timers times out to zero, the snubber bar 16 may be retracted or withdrawn to extend into the portion of the bore previously occupied by the blocking member and thus retract the control bar and door bolts connected to its outer end from the keeper sockets to permit opening of the safe or vault door.

In one satisfactory example, the housing or case 11 may be a two-piece housing formed of a main or rear housing portion **11*a* and a front cover portion 11*b*, with the main or rear housing portion 11*a* cast as a one-piece structure having a rear wall 20, top and bottom walls 21 and 22, and side walls 23,24. Axially aligned apertures 23*a*,24*a* are formed in the side walls 23,24 adjacent the top wall 21 aligned with the snubber bar receiving bore portion 17, defined in partition formations within the housing to provide an unblocked path between the apertures 23*a*,24*a* for receiving the locking bolt or snubber bar 16** for movement between projected or locking position and retracted or unlocking position. The locking bolt or snubber bar, as previously stated, is normally provided on the vault or safe door on which the time lock is installed.

The front cover portion **11*b* of the housing conventionally includes an elongated cutout window portion 26 through which the dials of the clockwork mechanisms or timer units 15 may be viewed, and a plurality of key receiving openings 27 are located in the front cover below the level of the window and aligned with appropriate parts of the three timer units to manually windup or set the timer units. Also, the front cover portion of the casing may be provided below the level of the keyholes 27 with a forwardly opening recess cavity 28 for access to the manual push lever 13 forming part of the blocking mechanism to permit one to manually effect emergency release to allow the lock to be opened should one be accidentally locked inside the vault or safe. For example, this push lever 13 and its association with the blocking member 18 may be of the general type disclosed in earlier U.S. patent application Ser. No. 940,834, filed Sept. 7, 1978, or of the type shown in U.S. Pat. No. 4,062,210, both owned by the assignee of the present invention. In these examples, the push lever, here indicated by the reference character 13, is in the form of an elongated lever extending through a slot in the carrier assembly 12 and includes an abutment shoulder 13*a* engaging a bounding portion, for example an angled corner, of an oversized slot 29 in the carrier assembly 12 through which the midportion of the push lever 13 extends, with the push lever biased downwardly by a spring 30 to the position shown in FIG. 3. The inner or rearmost end portion of the push lever 13 may be coupled or coact in a suitable way to a pivoted lever 31 or similar member having a portion underlying and bearing against a mechanism extending downwardly from the blocking member 18, such as the head 32*a* of the slide pin 32 spring biased downwardly by a spring 33 from the blocking member 18. It will be appreciated that when the pivoted lever 31 is in the raised position shown in FIG. 3, the contact portion of the pivoted lever bearing against the head 32*a* of the slide pin 32 lifts the head to a position causing the blocking member 18 to be in raised blocking position within the bore 17 for the snubber bar, assuming the snubber bar has been shifted outwardly to projected or locking position, thus blocking the snubber bar against inward movement to unlocking position. When the push lever 13 is manually swung upwardly to disengage the abutment shoulder 13*a* thereof from the abutment surface portion of the slot 29, or when the carrier assembly 12 is moved toward release position as later described by the timer unit, the pivoted lever 31 will be allowed to swing downwardly to a position lowering the upper portion of the blocking member 18 from the snubber bar bore 17 and thus permit retraction of the snubber bar 16 to the unlocking position. An antitampering wire 34 having its upper end fixed in the blocking member 18 may be provided rearwardly of the pin 32 as shown, extending downwardly through a slot in the head 32*a* to engage the lever 31 when the latter is in the raised position and hold the blocking member 18** in its raised blocking position.

The carrier assembly 12 of the present invention is of a novel construction which includes a main carrier plate member 35 which extends generally in a vertical plane transversely within the time lock housing for limited transverse sliding movement therein, and includes a pivoted deadbolt latch lever and a lever actuating control carrier plate relatively slidable on the main carrier plate member 35 as later described. The main carrier plate member 35 includes a lower carrier plate portion 35*a* having upwardly extending hooked arm extensions 36, one for each of the three timer or clock units 15, each arm 36 terminating in a vertical abutment surface 37 adapted to be engaged by the actuator of one or more of the timer or clock units 15. The timer or clock units 15 may be of customary construction wherein the actuator member is in the form of a rigid pin projecting forwardly from the dial 38 of each timer or clock unit 15 adapted to abut against the end abutment surface 37 of one of the carrier plate extension arms 36 to move the carrier plate laterally to release position, or the timer or clock units 15 may be of the type disclosed in said copending U.S. patent application Ser. No. 940,839, filed Sept. 7, 1978, wherein the actuator member for each timer unit is in the form of a kicker arm type carrier actuator, formed of kicker arm 39 as illustrated in FIG. 2 herein, to kick the carrier plate abruptly to release position when the associated timer unit times down to zero time. In either case, the rigid pin type actuator or the kicker arm type actuator moves the carrier plate member 35 laterally toward the right as viewed in FIG. 2 for a sufficient distance to disengage the abutment portion of the slot 29 in the lower carrier plate portion 35*a* from the lever abutment shoulder 13*a* and free the push lever 13 for forward or outward movement permitting lowering of the head portion 32*a* of the slide pin 32 a sufficient extent to drop the blocking member 18 downwardly out of blocking relation with the snubber bar bore 17.

The timer or clockwork mechanism 15 may include a clock gear train and escapement mechanism of conventional form well known in the clockmaking and time lock arts, or may include a clock gear train and escapement mechanism of the construction disclosed in said copending U.S. patent application Ser. No. 940,834 which in addition to the usual train of gear wheels or pinions and ratchet and pawl mechanism, also includes a clutch mechanism associated with one of the gear wheels, to permit rotation of the timer unit setting key 42 in a wind-down direction if one accidentally overdrives the key and the dial 38 which is usually directly gear coupled to the key driven main stem, so that oversetting of the dial to higher time settings can be corrected by rotation of the key in the wind-down direction.

The carrier assembly 12 of the time lock herein illustrated, as previously mentioned, includes in addition to the main carrier plate member 35 a deadbolt latch lever 60 which is pivotally supported on and immediately rearwardly of the main carrier plate member 35 between the main carrier plate member 35 and a deadbolt latch lever control carrier plate 61, referred to frequently hereinafter as the control plate. This control plate 61 does not suffer from the same restrictions due to functional requirements as the main carrier plate member 35, which required the main carrier plate to be strong and therefore massive, and thus the control plate 61 can therefore be made much thinner and less massive. The ratio of the force of the retaining spring for the control plate, hereinafter described as spring 68, to the mass of the control plate 61, is therefore much higher than its equivalent for the carrier plate 35 without unduly loading the timing mechanisms when releasing. This in itself gives much more security against undesired or unwanted opening in the presence of lateral shocks since much higher accelerations would be needed to shift the control carrier plate than are needed to shift the carrier plate in the absence of the deadbolt latch lever 60. The deadbolt latch lever control plate 61 is mounted on the carrier plate member 35 in rearwardly lapping relation to the upper region of the main carrier plate portion 35*a* by mounting screws 62 extending through slots 63 in the control plate 61 allowing a limited amount of lateral movement of the control plate 61 relative to the main carrier plate member 35. The deadbolt latch lever 60 has a latch arm 65 extending therefrom terminating in a notch 65*a*, for example a right angle notch or V-notch in the outer end portion thereof, to engage a corner of a right angular stationary shoulder formation indicated at 66, for example provided by an appropriately shaped enlarged rectangular formation formed in the lower right hand corner portion of the time lock case as viewed with reference to FIG. 2. The latch arm portion 65 is normally resiliently biased downwardly or in a clockwise direction as viewed in FIG. 7 about the pivot pin 67, pressed into the carrier plate 35, by spring 68, serving also as the retaining spring for the control plate 61, and is moved upwardly or in a counterclockwise direction about the pivot pin 67, as later described, by an actuating pin 69 projecting forwardly from a downwardly extending portion 70 of the control plate 61 into a slot 71*a* in a downwardly extending portion 71 of the latch lever 65 at a location below and near the pivot pin 67. The plate 61 also includes integral upwardly curving hook-shaped arms 72 generally duplicating the shape of the carrier plate extension arms 36 and terminating in abutment surfaces 73 which normally project slightly to the left of or in advance of the abutment surfaces 37 of the carrier plate extension arms 36. Because of this slight projection of the abutment surfaces 73 in advance relation or forwardly of the abutment surfaces 37 of the carrier plate extension arms 36, the control plate abutment end portions 73 are engaged by the actuator pin or kicker arm of the timer units slightly before the actuator pin or kicker arm engages the abutment surfaces 37 of the carrier plate member 35, thereby causing a slight amount of relative movement of the actuator plate 61 through substantially the distance permitted by the slots 63, thereby moving the pin 69 to the right from the position shown in FIG. 7, and effecting slight upward or counterclockwise movement of the lever 65 adequate to disengage its notch 65*a* from the stop shoulder corner formation 66 immediately prior to engagement of the timer unit actuating pin or kicker arm with the abutment surface 37 of the associated carrier plate extension arm 36.

The shape of the deadbolt latch lever or bolt member 60 having the latch arm 65 and the more massive upwardly projecting arm indicated at 60*a*, is made so that the lever 60 in itself is dynamically unbalanced, as will be readily apparent from FIG. 7. A force resulting from lateral accelerations tends to turn the lever 60 about its pivot 67 in a clockwise direction if the force acts to the right and in a counterclockwise direction if the force acts to the left. The control carrier plate 61 is by nature dynamically unbalanced and tends to shift toward the right or toward the left respectively if the acting force resulting from accelerations acts to the right or to the left respectively. The shape and mass of the lever or bolt member 60, the mass of the control plate 61, and the linkage between these two parts, namely the bolt or lever 60 and control plate 61, is made so that the two effects described above cancel and the two parts together form a dynamically balanced system. A force originating from a lateral acceleration and acting for instance toward the left tends to turn the bolt or lever 60 counterclockwise at the same time it tends to shift the control plate 61 to the left which through the linkage 69 tends to turn the bolt or lever 60 clockwise, cancelling any residual torque on the bolt or lever 60, and therefore eliminating any cause for the lever or bolt 60 to shift to the open or release position. The spring 68 is not even necessary but is provided basically for resetting purposes and can be made small. What is stated above also holds for forces acting to the right or from above or from below the assembly if the shape of the lever 60 is designed for this purpose. By this construction, the system of the bolt or lever 60 and control plate 61, being properly balanced dynamically, is insensitive to forces originating from shocks independent of their direction and amplitude.

It will be apparent, therefore, that when the timer unit actuator pin or kicker arm reaches the zero time position where it would engage the carrier plate arm abutment surface 37 to move the carrier plate towards release position, the timer unit actuator pin or kicker arm first engages the forwardly or advance projected abutment surface 73 of the associated control plate extension arm 72, shifting the control plate 61 to the right, as viewed in FIG. 7, and effecting a slight upward or counterclockwise movement of the deadbolt latch lever 60 because of the movement of the actuating pin 69 in the slot 71*a*. This upward or counterclockwise release movement of the deadbolt latch lever 60 disengages the notch formation 65*a* on the arm 65 of the deadbolt latch lever from the stop shoulder formation 66 and frees the carrier plate member 35 to which the deadbolt latch lever 60 is coupled for movement to the release position towards the right, as viewed in FIG. 7, responsive to engagement of the timer unit actuator pin or kicker arm with the abutment surfaces 37 on the extension arms of the carrier plate member 35.

I claim:

1. A time lock for bank vault doors and the like comprising a housing, a plurality of timer units of the settable dial type mounted in said housing, a carrier assembly transversely movable in the housing between a locking position and a release position for locking and releasing snubber bar blocking means, each of the timer units having a rotatable time-lapse indicating dial and clockwork mechanism and an actuator for engaging and moving the carrier assembly from said locking position to said release position when the dial reaches zero time position, said carrier assembly including a carrier plate having abutment formations to be engaged by each actuator when the associated timer dial reaches zero time position for moving the carrier plate and carrier assembly to release position, a control plate supported for limited relative movement with respect to the carrier plate having a projection adjacent each said abutment formation extending a short predetermined distance ahead of the abutment formation to be engaged by said actuator immediately prior to actuator engagement of the adjacent abutment formation as the adjacent timer nears zero time position to effect predetermined limited travel of the control plate relative to the carrier plate, a deadbolt latch lever pivotally mounted on the carrier plate and resiliently biased in a direction to releasably engage a stationary stop for holding the carrier plate against movement from said locking position when the carrier assembly is in said locking position, and the control plate having means for moving the deadbolt latch lever out of engagement with said stop upon movement of the control plate by the actuator relative to the carrier plate.

2. A time lock as defined in claim 1, wherein said carrier plate is a substantially vertical plate movable transversely of the housing in a vertical plane and having a lower body portion having latch shoulder means for locking and releasing of the blocking means and having upwardly curving extension arms projecting from said body portion adjacent the dial of each timer unit providing said abutment formations.

3. A time lock as defined in claim 2, wherein said deadbolt latch lever includes a first leg portion extending from the pivotal mounting and terminating in a shaped end portion for engaging said stationary stop and a second leg portion having a pin and slot connection with said other of said plates eccentrically of the pivotal mounting providing said means for moving the deadbolt latch lever.

4. A time lock as defined in claim 3, wherein said latch lever has a second leg portion extending upwardly in generally right angular relation to said first leg portion which is more massive than the first leg portion rendering the latch lever dynamically unbalanced and causing the latch lever to tend to rotate about its pivot responsive to lateral acceleration in a manner to substantially cancel effects of such lateral accelerations on said control plate.

5. A time lock as defined in claim 2, wherein said control plate has upwardly curving arm portions forming said projections conforming substantially to each of said extension arms and located immediately alongside its associated extension arm, said arm portion terminating in end portions extending slightly ahead of its associated abutment formation for prior engagement by the actuator of the associated timer.

6. A time lock as defined in claim 5, wherein said deadbolt latch lever includes a first leg portion extending from the pivotal mounting and terminating in a shaped end portion for engaging said stationary stop and a second leg portion having a pin and slot connection with said other of said plates eccentrically of the pivotal mounting providing said means for moving the deadbolt latch lever.

7. A time lock as defined in claim 6, wherein said latch lever has a second leg portion extending upwardly in generally right angular relation to said first leg portion which is more massive than the first leg portion rendering the latch lever dynamically unbalanced and causing the latch lever to tend to rotate about its pivot responsive to lateral acceleration in a manner to substantially cancel effects of such lateral accelerations on said control plate.

8. A time lock as defined in claim 5, wherein said deadbolt latch lever includes a first leg portion extending from the pivotal mounting and terminating in a notched end portion for engaging said stationary stop and a second leg portion having a pin and slot connection with said other of said plates eccentrically of the pivotal mounting providing said means for moving the deadbolt latch lever.

9. A time lock as defined in claim 1, wherein said carrier plate is a substantially vertical plate movable transversely of the housing in a vertical plane and having a lower body portion having latch shoulder means coactive with a manually operable control lever for locking and releasing of the blocking means and having upwardly curving extension arms projecting from said body portion adjacent the dial of each timer unit providing said abutment formations.

10. A time lock as defined in claim 9, wherein said control plate has upwardly curving arm portions forming said projections conforming substantially to each of said extension arms and located immediately alongside its associated extension arm, said arm portion terminating in end portions extending slightly ahead of its associated abutment formation for prior engagement by the actuator of the associated timer.

11. A time lock as defined in claim 10, wherein said deadbolt latch lever includes a first leg portion extending from the pivotal mounting and terminating in a shaped end portion for engaging said stationary stop and a second leg portion having a pin and slot connection with said other of said plates eccentrically of the pivotal mounting providing said means for moving the deadbolt latch lever.

12. A time lock as defined in claim 11, wherein said latch lever has a second leg portion extending upwardly in generally right angular relation to said first leg portion which is more massive than the first leg portion rendering the latch lever dynamically unbalanced and causing the latch lever to tend to rotate about its pivot responsive to lateral acceleration in a manner to substantially cancel effects of such lateral accelerations on said control plate.

13. A time lock as defined in claim 10, wherein said deadbolt latch lever is a generally bell-crank shaped member having a first leg portion extending from the pivotal mounting and terminating in a notched end portion for engaging said stationary stop and a short projection having a pin and slot connection with said other of said plates eccentrically of the pivotal mounting providing said means for moving the deadbolt latch lever.

14. A time lock as defined in claim 13, wherein said latch lever has a second leg portion extending upwardly in generally right angular relation to said first leg portion which is more massive than the first leg portion rendering the latch lever dynamically unbalanced and causing the latch lever to tend to rotate about its pivot responsive to lateral acceleration in a manner to substantially cancel effects of such lateral accelerations on said control plate.

15. A time lock as defined in claim 1, wherein said deadbolt latch lever includes a first leg portion extending from the pivotal mounting and terminating in a shaped end portion for engaging said stationary stop and a second leg portion having a pin and slot connection with said other of said plates eccentrically of the pivotal mounting providing said means for moving the deadbolt latch lever.

16. A time lock as defined in claim 15, wherein said latch lever has a second leg portion extending upwardly in generally right angular relation to said first leg portion which is more massive than the first leg portion rendering the latch lever dynamically unbalanced and causing the latch lever to tend to rotate about its pivot responsive to lateral acceleration in a manner to substantially cancel effects of such lateral accelerations on said control plate.

* * * * *